US008610370B2

(12) United States Patent
Krick et al.

(10) Patent No.: US 8,610,370 B2
(45) Date of Patent: Dec. 17, 2013

(54) METHOD FOR CONTROLLING LIGHT-EMITTING DIODES

(75) Inventors: Sebastian Krick, Paris (FR); Loïc Flandre, Saint-Maur-des-Fosses (FR)

(73) Assignee: Valeo Vision, Bobigny (FR)

( * ) Notice: Subject to any disclaimer, the term of this patent is extended or adjusted under 35 U.S.C. 154(b) by 338 days.

(21) Appl. No.: 13/180,792

(22) Filed: Jul. 12, 2011

(65) Prior Publication Data

US 2012/0025727 A1 Feb. 2, 2012

(30) Foreign Application Priority Data

Jul. 13, 2010 (FR) ..... 10 55735

(51) Int. Cl.
*G05F 1/00* (2006.01)

(52) U.S. Cl.
USPC ..... 315/291; 315/294; 315/360; 315/247; 315/307; 315/312; 323/280; 323/282

(58) Field of Classification Search
USPC ..... 315/169.1, 224–226, 247, 294, 297, 315/307, 312, 360, 362; 323/227, 280–282
See application file for complete search history.

(56) References Cited

U.S. PATENT DOCUMENTS

| | | | | |
|---|---|---|---|---|
| 7,019,506 | B2 * | 3/2006 | Kernahan | 323/284 |
| 7,425,803 | B2 | 9/2008 | Shao et al. | |
| 8,288,955 | B2 * | 10/2012 | Rowland | 315/224 |
| 8,487,546 | B2 * | 7/2013 | Melanson | 315/291 |
| 2006/0043911 | A1 | 3/2006 | Shao et al. | |
| 2008/0150449 | A1 | 6/2008 | Wang et al. | |
| 2008/0297069 | A1 | 12/2008 | Shao et al. | |

FOREIGN PATENT DOCUMENTS

DE 10236872 A1 3/2004

* cited by examiner

*Primary Examiner* — Haiss Philogene
(74) *Attorney, Agent, or Firm* — Jacox, Meckstroth & Jenkins

(57) ABSTRACT

A method and a device for gradually controlling the illuminating light intensity of light-emitting diodes by modulating the width of current pulses of defined duty cycle, using a DC-to-DC voltage converter and a control circuit for switching the supply current of the light-emitting diodes. Prior to switching the power supply of the diodes the DC-to-DC converter is initiated (A), so as to generate voltage pulses of defined duty cycle; the steady state of each pulse is determined (B), so as to generate a voltage pulse (CP) calibrated to a voltage level substantially corresponding to the steady-state level; and then the light-emitting diodes are powered (D) by applying each calibrated pulse to the light-emitting diodes by means of the switchable control circuit.

12 Claims, 3 Drawing Sheets

(10 LEDs)

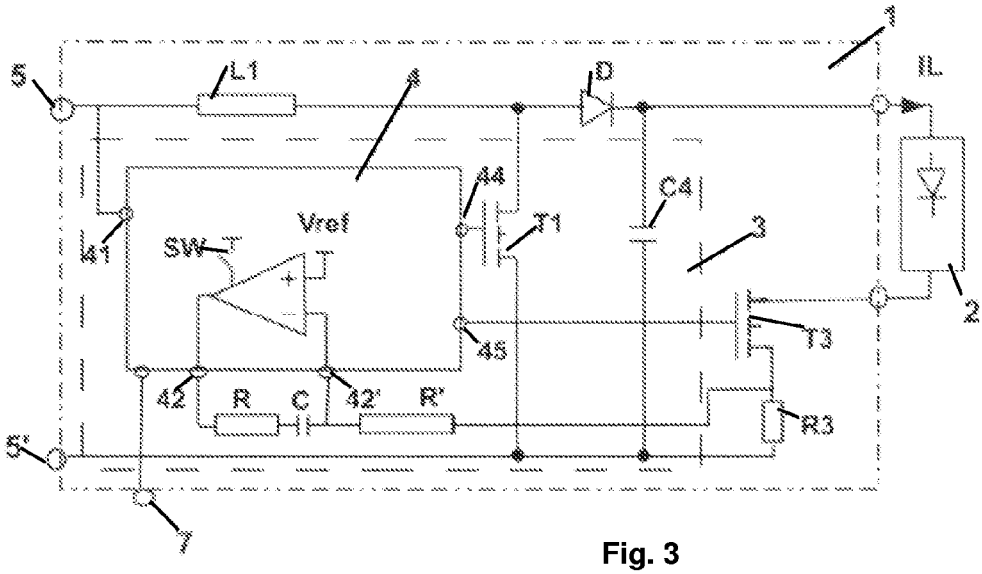
Fig. 3
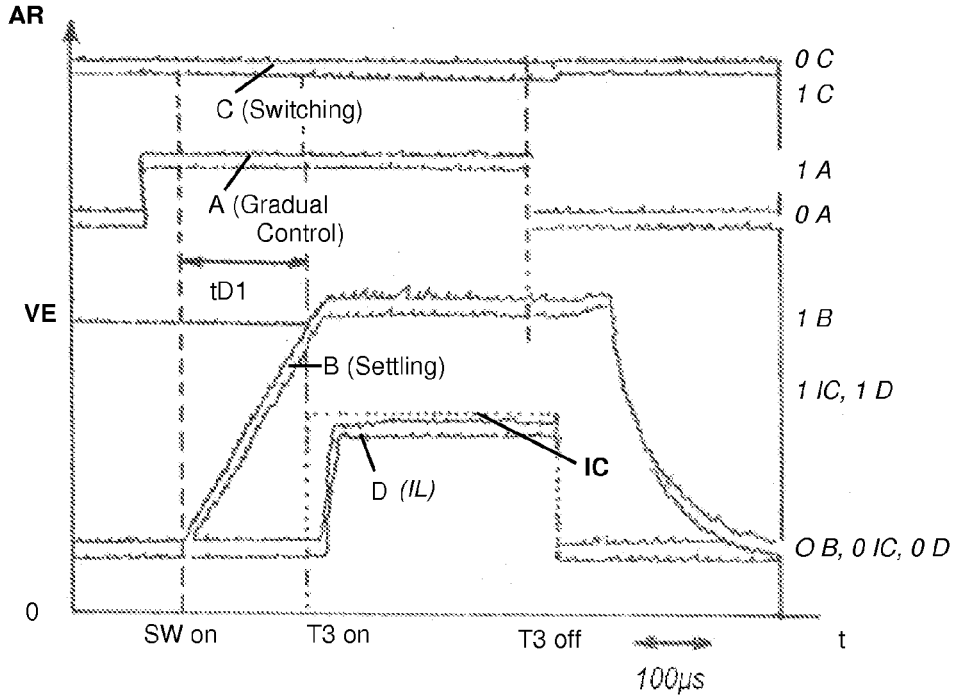
Fig. 4A (10 LEDs)

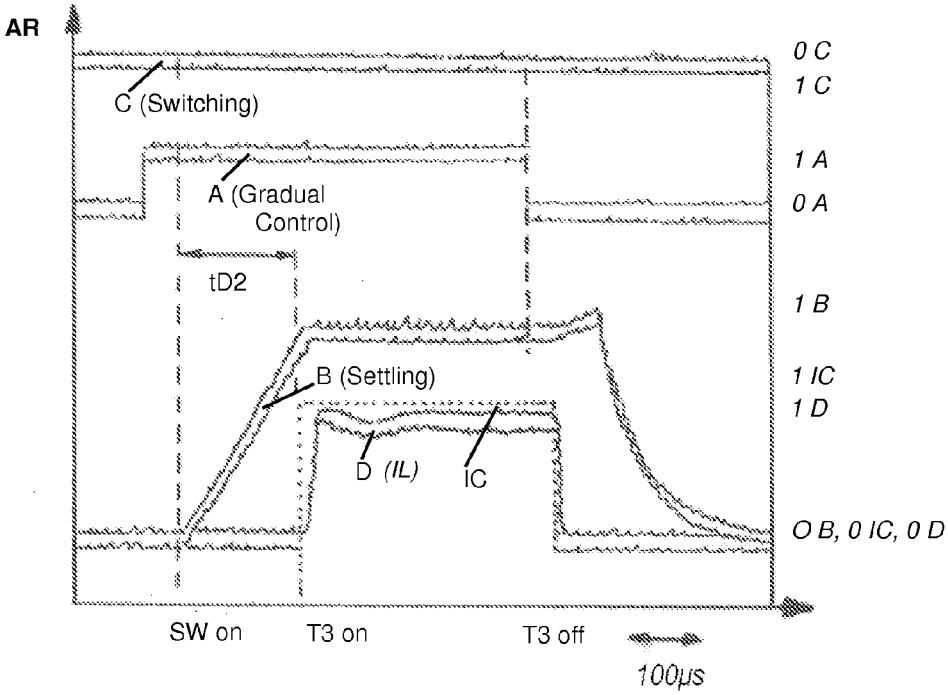
Fig. 4B (4 LEDs)

METHOD FOR CONTROLLING LIGHT-EMITTING DIODES

CROSS-REFERENCE TO RELATED APPLICATIONS

This application claims priority to French Application No. 1055735 filed Jul. 13, 2010, which application is incorporated herein by reference and made a part hereof.

BACKGROUND OF THE INVENTION

1. Field of the Invention

This invention relates to light-emitting diodes and more particularly, a system and method for controlling light-emitting diodes.

2. Description of the Related Art

At the present time light-emitting diodes, denoted LEDs hereafter, are increasingly being used to provide lighting and/or signalling functions for automotive vehicles.

Generally, several LEDs are associated in an optical unit and powered synchronously so as to ensure the aforementioned functions.

When, in particular, a gradual control of the illuminating light intensity, or dimming, of the LEDs must be achieved, the aforementioned groups of LEDs lend themselves satisfactorily to such a control mode, by means of a modulation of the duration, called the width, of the current pulses powering these groups. The modulation of the width of the pulses, voltage pulses converted into current pulses by the internal impedance of the aforementioned LEDs, is obtained, for example, using a DC-to-DC voltage converter, with which a switchable control circuit is associated that is controlled by a gradual control signal that makes it possible consequently to adjust the duty cycle and therefore the width of the current pulses powering the LEDs, and finally the electrical power delivered to the latter and therefore the illuminating light intensity of the groups of LEDs powered in this way.

The aforementioned operating mode is completely satisfactory, at least with regard to pulses having high duty cycles, higher than about 20%, i.e., for average or high LED illumination levels.

In particular, for conventional DC-to-DC converter circuit/switchable control circuit pairs, since the switchable control circuit comprises a proportional-integral loop for controlling the voltage level of the pulses, the limited dynamic, i.e., response time, of the assembly thus arranged means that the power supplied to the LEDs takes too long to settle.

Furthermore, when a gradual control of the illuminating light intensity of the LEDs is applied so as to obtain low lighting level, the duty cycle of the supply pulses then being set to a value lower than a value of about 20%, the excessively slow rise time of the pulses reduces the average value of the current supplied to the LEDs, which average value is no longer equal to the product of the amplitude value of the pulses in the steady state and the duty cycle value used for application of the gradual control. This results in a non-linearity of the gradual control, which causes this control to be less precise. Furthermore, the average value of the supply current of the LEDs depends on the supply voltage.

A solution intended to obviate the aforementioned drawbacks has been provided in patent DE 10236872.

In the aforementioned solution an analogue circuit, having in series a capacitor and a resistor R2, C2, controlled by a switch T2, as shown in FIG. 1, (a reproduction of FIG. 2 of the aforementioned patent), in fact enables the maximum value of the amplitude of the pulses to be sampled and stored for the following pulse.

Such a system is satisfactory technically, but it requires perfect synchronization of the switching of the switch T2 and the switch T3 enabling application of the supply pulses to the LEDs.

Furthermore, such a solution requires the use of a specific switchable control circuit 4 that must withstand the connection of the sampling circuit R2, C2 to the reference voltage, ground, of the device via the switch T2.

This is not the case for conventional switchable control circuits normally available on the market.

What is needed, therefore, is a system and method for controlling LEDs that improves over those of the past.

SUMMARY OF THE INVENTION

Consequently, the object of the present invention is to alleviate the drawbacks of the prior-art device.

In particular, one embodiment of the present invention is the implementation of a method for gradually controlling the illuminating light intensity of LEDs, which enables power to be supplied to the LEDs conditionally upon the steady state of the power supply pulses determined for the latter, thereby substantially reducing, if not removing, any imprecision in the gradual control of the illuminating light intensity finally obtained at low lighting levels.

Another embodiment of the present invention is the implementation of a device for gradually controlling the illuminating light intensity of LEDs, which makes use of a conventional DC-to-DC converter with which a conventional switchable control circuit is associated, the latter not requiring connection to a ground plane.

The method for gradually controlling the illuminating light intensity of light-emitting diodes by modulating the width of current pulses of defined duty cycle, subject of the invention, is implemented using a DC-to-DC voltage converter and a control circuit for switching the supply current of the light-emitting diodes.

This method is remarkable in that it consists, at least in succession, prior to switching the power supply of the diodes, in initiating the DC-to-DC converter so as to generate voltage pulses of defined duty cycle, determining the steady state of each pulse so as to generate a voltage pulse calibrated to a voltage level substantially corresponding to the steady-state level, and then powering the light-emitting diodes by applying each calibrated pulse to the light-emitting diodes by means of the switchable control circuit.

The method that is a subject of the invention is also remarkable in that the step consisting in determining the steady state of each pulse comprises detecting the amplitude level of each pulse with respect to a reference value.

The method that is a subject of the invention is also remarkable in that the step consisting in determining the steady state of each pulse comprises calculating the settling time taken by each pulse to reach the steady state.

The method that is a subject of the invention is finally remarkable in that for a switchable control circuit comprising a proportional-integral loop for controlling the voltage level of the pulses, this loop consists in calculating the settling time, and delaying the application of each calibrated pulse to the light-emitting diodes by a delay time substantially equal to the settling time.

The device for gradually controlling the illuminating light intensity of light-emitting diodes by modulating the width of pulses of defined duty cycle, subject of the invention, comprises a DC-to-DC voltage converter and a control circuit for switching pulses supplying the light-emitting diodes with current.

It is remarkable in that it furthermore comprises resources for determining the steady state of each pulse delivered by the DC-to-DC converter so as to generate a calibrated pulse, and, when this steady state has been reached, resources for controlling the power supplied to the light-emitting diodes by application of each calibrated pulse to the light-emitting diodes.

The device that is a subject of the invention is furthermore remarkable in that the resources for determining the steady state of each pulse comprise means for detecting the amplitude level of each pulse with respect to a reference value.

The device that is a subject of the invention is also remarkable in that the resources for determining the steady state of each pulse comprise means for calculating the settling time.

The device that is a subject of the invention is finally remarkable in that, for a switchable control circuit comprising a proportional-integral loop for controlling the voltage level of the pulses, this loop comprises means for calculating the rise time of each pulse, and a circuit for delaying the application of each calibrated pulse to the light-emitting diodes by a delay time substantially equal to the rise time of each pulse.

A more detailed description of the method and of the device for gradually controlling the illuminating light intensity of light-emitting diodes, in accordance with the subject of the present invention, will now be given in relation to the appended drawings.

BRIEF DESCRIPTION OF THE ACCOMPANYING DRAWINGS

FIG. 1 relates to the prior art and corresponds to FIG. 2 of the aforementioned patent DE 10236872;

FIG. 3 shows, by way of non-limiting example, a circuit diagram of a preferred embodiment of the device that is a subject of the invention;

FIG. 4A shows, by way of non-limiting example, a timing diagram of the various successive signals generated by the device that is a subject of the invention, such as shown in FIG. 3, for a load formed by a group of LEDs comprising 10 LEDs, in order to provide a lighting function, for an automotive-vehicle headlamp, for example; and FIG. 4B shows, by way of non-limiting example, a timing diagram of the various successive signals generated by the device that is a subject of the invention, as shown in FIG. 3, for a load formed by a group of LEDs comprising 4 LEDs, in order to provide a signalling function for an automotive-vehicle light, for example.

DETAILED DESCRIPTION OF THE PREFERRED EMBODIMENTS

Figure 1:
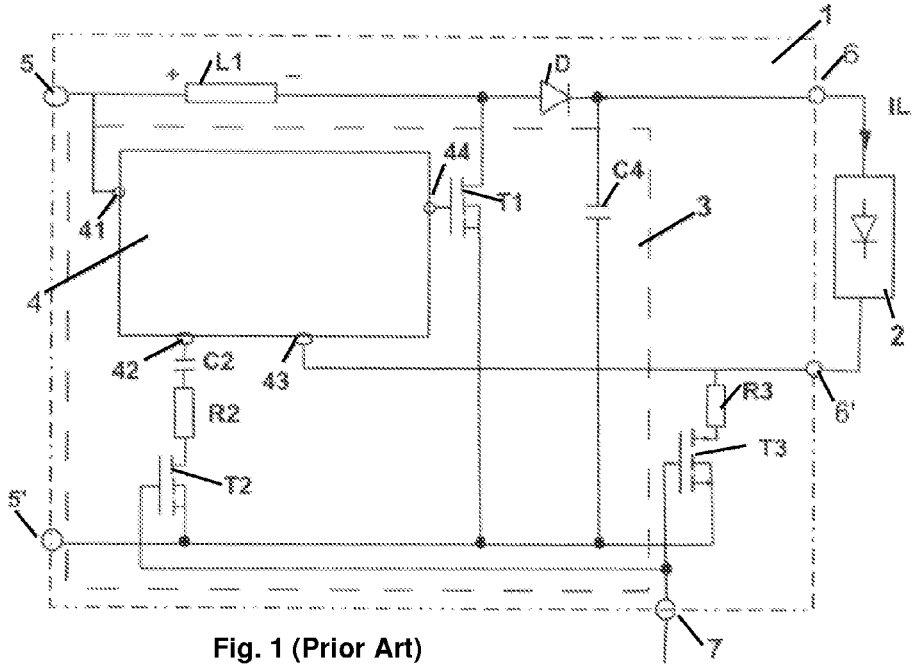
Fig. 1 (Prior Art)
Figure 2:
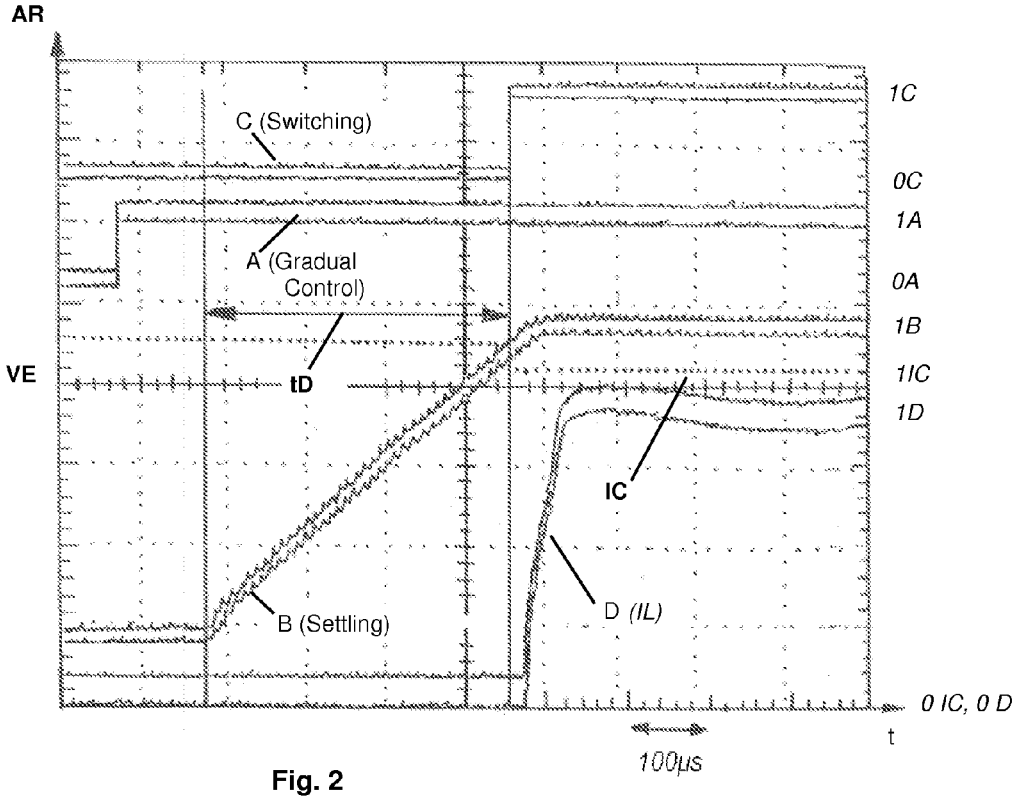
FIG. 2 shows, by way of non-limiting example, a timing diagram of the essential steps for implementing the method that is a subject of the invention, steps illustrated by the various signals generated following a user request for a gradual control.

A more detailed description of the method that is a subject of the invention will now be given in relation to FIG. 2. In FIG. 2 and FIGS. 4A and 4B, which show timing diagrams of signals recorded using a multi-channel oscilloscope, the relative amplitude RA is measured along the Y-axis, showing in fact the high and low levels of the various signals, and time is measured along the X-axis, 1 cm representing 100 μs.

The aforementioned method, in a non-limiting way, preferably relates to the gradual control of the illuminating light intensity of light-emitting diodes by modulating the width of current pulses, the duty cycle of which pulses is defined, depending on the use, in particular when this duty cycle is lower than 20%, for example, using a DC-to-DC voltage converter and a control circuit for switching the current supplied to the light-emitting diodes.

With reference to the aforementioned FIG. 2, the method consists, at least in succession, in initiating, A, the DC-to-DC converter, and, of course, in applying the gradual control so as to generate voltage pulses of defined duty cycle, corresponding to the use requested by the user of the vehicle. This operation is shown by the curve A, showing the jump in gradual control voltage, in the drawing.

The aforementioned step is followed by a step consisting in determining the steady state SS of each pulse so as to generate a calibrated voltage pulse CP the voltage level of which corresponds substantially to the steady-state level of the pulses. In FIG. 2, the settling of the pulse of defined duty cycle corresponding to the gradual control generated by the curve A is referenced with the letter B, this settling denoted Settling supposedly corresponding to the settling of the current in a resistor/capacitor circuit, as will be described later on in the description.

When the steady state SS is reached, the method that is a subject of the invention consists in powering D the light-emitting diodes by applying the calibrated pulse CP to the light-emitting diodes by means of the switchable control circuit. It is understood, in particular, that on reaching the steady state SS the voltage switching, for generating the calibrated pulse CP, is carried out with no appreciable delay, the aforementioned voltage pulse enabling the LEDs to be supplied with power, according to the curve D shown in FIG. 2, which represents the timing diagram of the current IL delivered to the LEDs.

Generally, and in a first non-limiting implementation of the method that is a subject of the invention, the step consisting in determining the steady state of each pulse comprises detecting the amplitude level SS of each pulse, with respect to a reference value.

According to a second non-limiting preferred embodiment of the method that is a subject of the invention, the step consisting in determining the steady state of each pulse comprises calculating the settling time, denoted tS in FIG. 2, of each pulse.

In particular, the method that is a subject of the invention may in a particularly advantageous way be implemented for a switchable control circuit comprising a proportional-integral loop for controlling the voltage level of the pulses, this circuit amounting to a resistor/capacitor circuit, as will be described later on in conjunction with FIG. 3.

In this case, the method that is a subject of the invention consists in calculating the settling time tS of each pulse and in delaying the powering of the LEDs, by applying each calibrated pulse PC to the latter, delayed by a delay time substantially equal to the settling time tS.

Thus, with reference to the aforementioned FIG. 3, the references 5 and 5' denote the input terminals for power supplied by the battery of the vehicle to the device 1 for gradually controlling the illuminating light intensity of the light-emitting diodes by modulating the width of pulses of defined duty cycle, a subject of the invention. In FIG. 3, the reference 5' denotes, for example, ground. This device comprises a DC-to-DC voltage converter 3 and a voltage booster formed by a self inductance L1, the switching transistor T1, the diode D and the capacitor C4. However, it should in particular be noted that any type of voltage booster, buck, buck-boost, SEPIC or Ćuk converters, for example, and finally any type of DC-to-DC converter may be used. The assembly thus formed must deliver supply pulses in succession to the load 2 consisting of the LEDs. This load 2 is connected to the connection terminals 6 and 6' and the current IL, regulated depending on the gradual control applied, is delivered to these terminals. Other configurations of the aforementioned supply circuit may be envisaged.

Furthermore associated with the aforementioned DC-to-DC voltage converter 3 is a control circuit 4 for switching supply pulses.

The latter is supplied with the supply voltage via the connection terminal 41. It comprises an internal reference voltage denoted Vref and an operational amplifier 40 receiving at its positive terminal the reference voltage Vref and the negative terminal of which is connected to an input terminal 42'. The switching transistor T1 is controlled by the output 44 of the control circuit 4 for switching supply pulses.

The input terminal 7 of the device 1 that is a subject of the invention is connected to the input 42 of the control circuit 4 and receives the gradual control signal that is representative of the width modulation of the pulses. This signal may be delivered either externally via the input terminal 7 or internally. The output terminal 45 of the control circuit 4 is connected to the control input of a switching transistor T3, which is connected in series on the one hand to the load 2 consisting of the LEDs and on the other hand to a resistor R3, itself connected to the terminal 5' for supplying power to the device 1 that is a subject of the invention. It is understood, in particular, that the resistor R3 has the function of measuring and of returning an image of the value of the current IL flowing through the load 2 consisting of the LEDs. The capacitance C4 of the voltage booster is connected on the one hand to the terminal 5' for supplying power to the device 1 and, on the other hand, to the load 2 consisting of LEDs.

Finally, the output of the operational amplifier 40 is connected to the terminal 42 of the control circuit 4 for switching supply pulses and the terminals 42 and 42' of the latter circuit are connected via a series resistor/capacitor circuit R, C. The terminal 42' is furthermore connected by a resistor R' to the terminal common to the switching transistor T3 and the resistor R3.

The operational amplifier 40 is equipped with a switch SW, which makes it possible to synchronize the integration carried out by the aforementioned operational amplifier, the circuit R, C and the abovementioned resistor R'.

During a gradual control, the operational amplifier 40, controlled by the switch SW, makes it possible to compare the voltage VR3 across the terminals of the resistor R3, image of the current IL, to the internal reference voltage Vref and then processes the discrepancy between the two voltage values by integrating, using a proportional-integral loop, the voltage level of the pulses.

The constant of integration is set by the value of the R'C time constant. The output terminal 44 delivers a voltage value which varies depending on the result of the integration performed by the proportional-integral control loop.

The value of the voltage applied to the input terminal 42' is given by the relationship (1), when R is very much higher than R':

$$Vop(t)=[1/R'C]*[\int(Vref-VR3)\,dt]. \quad (1)$$

In this relationship, Vop(t) denotes the output voltage of the operational amplifier 40.

In the particular embodiment of the device that is a subject of the invention, as shown in FIG. 3, the settling time tS in FIG. 2 elapses between the activation of the proportional-integral loop, on switching of the switch SW, and the delayed effective control of the switching transistor T3.

As mentioned above in the description relating to the gradual control method that is a subject of the invention, the value of the output voltage of the operational amplifier 40 may be obtained in two different ways:

- either tS, the settling time, is calculated, because the values of R, R', C and Vref are known and VR3=0 (because the transistor T3 has still not been switched the current IL is still zero) and the target value of the output voltage of the operational amplifier 40 is also known and equal to the value SS, the value in the steady state. It is then possible to calculate the value of the settling time tS using the relationship (2):

$$Vop(tD)=[1/R'C]*[Vref*tS]=SS, \quad (2)$$

i.e., tS=R'C[VE/Vref];

- or the output voltage Vop(t) of the operational amplifier 40 is measured and the moment when it reaches the steady-state voltage SS is detected.

This output voltage is related by the gain M of the DC-to-DC converter to the duty cycle $\alpha$ of the latter which itself defines the gain or voltage magnitude ratio M=VLED/VBAT, in which relationship VLED denotes the voltage across the terminals of the load 2 and VBAT denotes the supply voltage across the terminals 5 and 5' of the device 1 that is a subject of the invention, i.e., the battery voltage of the vehicle, with $M=[1/(1-\alpha)]$.

Thus, the steady-state value SS of the voltage pulses may be calculated when VLED, VBAT and the gain M of the DC-to-DC converter are known.

According to a remarkable aspect of the device and method that are subjects of the invention, it is therefore entirely conceivable:

- either to set tS so as to detect the corresponding value of the output voltage Vop(t) of the operational amplifier 40, as described above, and finally to generate the successive calibrated pulses CP; resources for calculating tS according to the aforementioned relationship (2) may then be provided;
- or to implement an adaptive system, as shown in FIG. 3, which can adjust the output voltage Vop(t) of the operational amplifier 40 by measuring, by sampling, for example, VLED and VBAT the gain of the DC-to-DC converter 3 being known.

In both cases, reaching the steady state SS makes it possible to control, using a control pulse delivered to the terminal 45 of the control circuit 4, the transistor T3 so as to apply the calibrated pulse CP and power the LEDs that make up the load 2.

The voltage VLED, across the terminals of the load 2, varies slowly as a function of temperature but also when the current flowing through the LEDs is changed by changing the reference voltage Vref. The voltage VLED is also modified from one embodiment to another, i.e., for different lighting or signalling functions, when of course the type and number of LEDs making up the load 2 are changed.

The largest change to the voltage VLED across the load 2 occurs if the type and number of light-emitting diodes are changed. Consequently, measurement of VLED must be performed only when the current IL flowing through the load 2 has stabilized, i.e., when VR3=Vref. For this purpose, it is possible to envisage, on initiation of the device 1 that is a subject of the invention, the first high-voltage-value phase of the pulses generated by the gradual control being chosen to be longer, greater pulse widths, so as to perform a measurement of VLED at the end of this phase. High-speed electronics may consequently be chosen.

In FIGS. 4A and 4B, timing diagrams are shown for signals obtained by virtue of the implementation of the method that is a subject of the invention according to the embodiment of the device shown in FIG. 3, for a load consisting of ten LEDs and four LEDs respectively.

The high and low levels of the signals are denoted 0A, 1A; 0B, 1B; 0C, 1C, 0D, 1D; and 0CP, 1CP for the signals represented by the curves A, B, C, D and CP respectively. It is observed that the settling time tS2 for 4 LEDs is lower than the settling time tS1 for 10 LEDs. Moreover, all else being equal (the successive stages of switching of the switches SW and T3 being shown by dot-dash lines reference SW on, T3 on, T3 off), it is noted in particular that the switching control of T3, directly generated by the control circuit 4, causes the current IL delivered to the LEDs to drop.

While the system, apparatus and method herein described constitute preferred embodiments of this invention, it is to be understood that the invention is not limited to this precise system, apparatus and method, and that changes may be made therein without departing from the scope of the invention which is defined in the appended claims.

What is claimed is:

1. A method for gradually controlling the illuminating light intensity of light-emitting diodes by modulating the width of current pulses of defined duty cycle, using a DC-to-DC voltage converter and a control circuit for switching the supply current of said light-emitting diodes, wherein it consists, at least in succession, prior to switching the power supply of the diodes, in:

initiating the DC-to-DC voltage converter so as to generate voltage pulses of defined duty cycle;

determining the steady state of each pulse so as to generate a voltage pulse calibrated to a voltage level substantially corresponding to the steady-state level; and then powering the light-emitting diodes by applying each calibrated pulse to the light-emitting diodes by means of the switchable control circuit.

2. The method according to claim 1, wherein the step consisting in determining the steady state of each pulse comprises detecting an amplitude level of each pulse with respect to a reference value.

3. The method according to claim 1, wherein the step consisting in determining the steady state of each pulse comprises calculating the settling time of each pulse.

4. The method according to claim 3, wherein for a switchable control circuit comprising a proportional-integral loop for controlling the voltage level of the pulses, this method consisting in:

calculating the settling time of each pulse; and delaying the application of each calibrated pulse to the light-emitting diodes by a delay time substantially equal to the settling time.

5. A device for gradually controlling the illuminating light intensity of light-emitting diodes by modulating the width of pulses of defined duty cycle, comprising a DC-to-DC voltage converter and a control circuit for switching pulses supplying the light-emitting diodes with current, wherein it furthermore comprises:

means for determining the steady state of each pulse delivered by the DC-to-DC voltage converter so as to generate a calibrated pulse; and, when this steady state has been reached; and means for controlling the power supplied to the light-emitting diodes by application of each calibrated pulse to the light-emitting diodes.

6. The device according to claim 5, wherein the means for determining the steady state of each pulse comprise means for detecting an amplitude level of each pulse with respect to a reference value.

7. The device according to claim 5, wherein the means for determining the steady state of each pulse comprise means for calculating a settling time of each pulse.

8. The device according to claim 7, wherein for a switchable control circuit comprising a proportional-integral loop for controlling the voltage level of the pulses, this loop comprises:

means for calculating the rise time of each pulse; and a circuit for delaying the application of each calibrated pulse to the light-emitting diodes by a delay time substantially equal to the rise time of each pulse.

9. A device for gradually controlling the illuminating light intensity of light-emitting diodes by modulating the width of pulses of defined duty cycle, comprising:

a DC-to-DC voltage converter;

a control circuit for switching pulses supplying the light-emitting diodes with current;

a device for determining the steady state of each pulse delivered by the DC-to-DC voltage converter so as to generate a calibrated pulse; and, when this steady state has been reached; and a control for controlling the power supplied to the light-emitting diodes by application of each calibrated pulse to the light-emitting diodes.

10. The device according to claim 9, wherein said device for determining the steady state of each pulse comprises a detector for detecting an amplitude level of each pulse with respect to a reference value.

11. The device according to claim 9, wherein said device for determining the steady state of each pulse calculates a settling time of each pulse.

12. The device according to claim 11, wherein for a switchable control circuit comprising a proportional-integral loop for controlling the voltage level of the pulses, said proportional-integral loop comprises:

a calculator for calculating the rise time of each pulse; and a circuit for delaying the application of each calibrated pulse to the light-emitting diodes by a delay time substantially equal to the rise time of each pulse.

* * * * *